US008836303B2

(12) United States Patent
Nápravnik et al.

(10) Patent No.: US 8,836,303 B2
(45) Date of Patent: Sep. 16, 2014

(54) ACTIVE LEAKAGE CONSUMING MODULE FOR LDO REGULATOR

(75) Inventors: Karel Nápravnik, Prague (CZ); Alexandre Pons, Vizille (FR)

(73) Assignee: ST-Ericsson SA, Plan-les-Ouates (CH)

( * ) Notice: Subject to any disclaimer, the term of this patent is extended or adjusted under 35 U.S.C. 154(b) by 0 days.

(21) Appl. No.: 13/996,409

(22) PCT Filed: Dec. 13, 2011

(86) PCT No.: PCT/EP2011/072665

§ 371 (c)(1),
(2), (4) Date: Aug. 8, 2013

(87) PCT Pub. No.: WO2012/084616

PCT Pub. Date: Jun. 28, 2012

(65) Prior Publication Data

US 2013/0314063 A1 Nov. 28, 2013

Related U.S. Application Data

(60) Provisional application No. 61/487,929, filed on May 19, 2011.

(30) Foreign Application Priority Data

Dec. 21, 2010 (EP) ..... 10306473

(51) Int. Cl.
*G05F 1/56* (2006.01)

(52) U.S. Cl.
USPC ..... 323/274; 323/275

(58) Field of Classification Search
USPC ..... 323/273–280
See application file for complete search history.

(56) References Cited

U.S. PATENT DOCUMENTS

| | | | | |
|---|---|---|---|---|
| 7,262,585 | B2 * | 8/2007 | May | 323/273 |
| 7,723,968 | B2 * | 5/2010 | Okuyama et al. | 323/274 |
| 7,821,240 | B2 * | 10/2010 | Oddoart et al. | 323/269 |
| 2004/0130378 | A1 | 7/2004 | Kihara | |
| 2006/0113972 | A1 | 6/2006 | Mihara | |
| 2010/0148735 | A1 * | 6/2010 | Napravnik | 323/280 |

FOREIGN PATENT DOCUMENTS

| | | | |
|---|---|---|---|
| EP | 1965283 | A1 | 9/2008 |
| JP | H10301642 | A | 11/1998 |

* cited by examiner

*Primary Examiner* — Jessica Han
(74) *Attorney, Agent, or Firm* — Coats & Bennett, P.L.L.C.

(57) ABSTRACT

An active leakage consuming module (1001) is to be added to an LDO regulator without modification of the structure of this latter. The module provides a low-power operating mode with reduced current consumption, without impairing an operation of the LDO regulator for higher currents output by said LDO regulator. The module comprises a leakage current path (54) and control means (40, 50) for conducting consumed current below a threshold out of a pull-down path of the LDO regulator.

12 Claims, 5 Drawing Sheets

ACTIVE LEAKAGE CONSUMING MODULE FOR LDO REGULATOR

The invention relates to an active leakage consuming module for LDO regulator, and to an LDO regulator provided with such module.

BACKGROUND OF THE INVENTION

LDO (Low Drop-Out) regulators are very commonly used and may have different structures. The present invention is directed to improving LDO regulators which have structures in accordance with FIG. 1. Such LDO regulator comprises a differential amplifier 10, a gain stage 20 and an output stage 30.

The differential amplifier 10 has a reference input terminal 1, a feedback input terminal 2 and an output terminal 3.

The gain stage 20 comprises a bias resistor 21 and a MOS transistor 22. This MOS transistor 22 has a first main terminal which is connected to a first terminal 100 of a power supply unit of the LDO regulator. A second main terminal of the MOS transistor 22 is connected to a second terminal 101 of the power supply unit through the bias resistor 21, and a gate terminal of the MOS transistor 22 is connected to the output terminal 3 of the differential amplifier 10.

The output stage 30 comprises a switch, here in the form a transistor 31, in the following referred to as "the powerMOS transistor 31", and a pull-down path 32. The powerMOS transistor 31 has a first main terminal which is connected to the terminal 100 of the power supply unit through the pull-down path 32, a second main terminal which is connected to the terminal 101 of the power supply unit, and a gate terminal which is connected to a node of the gain stage 20 between the bias resistor 21 and the MOS transistor 22. The output stage 30 further comprises a node between the powerMOS transistor 31 and the pull-down path 32 which forms an output terminal 33 of the LDO regulator. The pull-down path 32 comprises itself a feedback output terminal 34 which is designed for supplying a feedback voltage representative for an LDO output voltage $V_{OUT}$ existing at the output terminal 33 of the LDO regulator. This feedback output terminal 34 is connected to the feedback input terminal 2 of the differential amplifier 10.

The powerMOS transistor 31 and the MOS transistor 22 of the gain stage 20 are of opposite transistor types. For illustration purpose, the voltage of the second terminal 101 of the power supply unit (not represented) is higher than that of the first terminal 100, this latter being represented as a grounded terminal. Then, the powerMOS transistor 31 is of p-type, and the MOS transistor 22 is of n-type. The types of all transistors considered in the present specification are to be exchanged if the polarity of the power supply unit is swapped between the terminals 100 and 101.

Reference 1000 denotes generally such LDO regulator as a whole. A load resistance $R_{load}$ is connected between the output terminal 33 of the LDO regulator 1000 and the terminal 100 of the power supply unit. $C_{load}$ denotes a decoupling capacitor used commonly but optionally in a known manner at the output terminal 33 of the LDO regulator 1000.

Also in a known manner, resistor R and capacitor C are arranged for ensuring stability of the LDO regulator 1000. They are optional and not related to the present invention. Other arrangements are also known for compensating frequency effect.

The following voltages are also indicated in FIG. 1:

$V_{REF}$: voltage applied on the reference input terminal 1, $V_{BAT}$: output voltage of the power supply unit, $V_{B1}$: bias-voltage applied to the differential amplifier 10, $V_{O1}$: output voltage supplied by the differential amplifier 10 to the gate terminal of the MOS transistor 22, $V_{GATE}$ voltage supplied by the gain stage 20 to the gate electrode of the powerMOS transistor 31, $V_{OUT}$: voltage existing at the output terminal 33 of the LDO regulator 1000, and $V_{FB}$: feedback voltage supplied by the pull-down path 32 and transmitted to the feedback input terminal 2 of the differential amplifier 10.

For example purpose, the pull-down path 32 comprises two series-connected resistors $R_{FB1}$ and $R_{FB2}$, with a node intermediate to these latter resistors which forms the feedback output terminal 34. FIGS. 2*a* to 2*c* show other possible structures for the output stage 30. These structures implement different designs for the pull-down path 32, but they are all well-known to the Man skilled in electronics, so that it is useless describing them here. However, the invention disclosed hereunder in the present application may be implemented with any design of the pull-down path 32.

Such LDO regulator in use conducts a current between the terminals 100 and 101 of the power supply unit, in addition to the current fed into the load resistor $R_{load}$. This current internal to the LDO regulator 1000 is called consumed current and constitutes energy loss.

When the load resistor $R_{load}$ is disconnected from the output terminal 33, there still flows a quiescent current through the LDO regulator 1000. A major part of this quiescent current is produced at the interface between the gain stage 20 and the output stage 30, because the output impedance of the gain stage 20 is low for ensuring good dynamic performances. Another part of the quiescent current flows through the powerMOS transistor 31 and the pull-down path 32. For pull-down efficiency, the total resistance of the pull-down path 32 cannot be too high and, even when the powerMOS transistor 31 is in off-state, a leakage current of this powerMOS transistor 31 still flows from the terminal 101 to the terminal 100 through the pull-down path 32. Then, this leakage current participates to the current consumed by the LDO regulator 1000.

The quiescent current is significant when the load resistor $R_{load}$ is important, i.e. when the output current supplied by the LDO regulator 1000, from the output terminal 33 into the load resistor $R_{load}$, is low. This output current is denoted $I_{load}$ in FIG. 1.

Several circuitry modifications have already been proposed for reducing the consumed current of an LDO regulator, including for small output current values. In particular, document US 2010/0148735 discloses modifying the bias of the differential amplifier and the structure of the gain stage, for obtaining a consumed current which is proportional to the output current of the LDO regulator. This is beneficial for low values of the output current, but detrimental for higher values of the output current. In addition, the structure modifications proposed in US 2010/0148735 require to re-design the LDO regulator topology, and alter the dynamic performances of the LDO regulator over the whole output current range.

Document US 2002/0125866 discloses adding a second output stage specifically adapted for small output current values, in parallel to the output stage commonly used. Then both output stages are operating together when the output current is not limited to small values, and stability issues arise which must be solved separately.

Finally, document JP 10-301642 discloses using a passive leakage consuming circuit which corresponds to the structure shown in FIG. 2*c*. The circuit of FIG. 3 of this document creates an unregulated pull-down current even if the leakage current can be consumed by the external load. Then, the leakage current is flown uselessly internally to the leakage consuming circuit. For avoiding such situation, the circuit is completed as shown in FIG. 4 of this document so as to switch off the leakage consuming circuit when the external load current exceeds a maximum value. In addition, for both circuits of FIGS. 3 and 4, the leakage current which is conducted through the pull-down path is unregulated.

SUMMARY OF THE INVENTION

An object of the present invention is to provide for relatively small power consumption in an LDO regulator.

According to a first aspect, there is provided an active leakage consuming module, which is suitable for being connected to an LDO regulator when this LDO regulator comprises an output stage, which itself comprises a switch and a pull-down path. The switch has a first main terminal which is connected to a first terminal of a power supply unit through the pull-down path, a second main terminal which is connected to a second terminal of the power supply unit, and a control terminal. Additionally, a node between the switch and the pull-down path forms an output terminal of the LDO regulator.

The LDO regulator itself is external to the active leakage consuming module, this latter being concerned by the first aspect of the invention.

The active leakage consuming module comprises:

- a leakage current path with a first terminal of this leakage current path to be connected to the first terminal of the power supply unit, and a second terminal of the leakage current path to be connected to the output terminal of the LDO regulator;
- first control means to be connected to the control terminal of the switch, and adapted to switch off said switch before the leakage current path is activated, when the current in the first main terminal of the switch is continuously decreasing during an operation of the LDO regulator provided with the active leakage consuming module; and
- second control means adapted to activate the leakage current path only after the switch has been switched off during the operation of the LDO regulator provided with the active leakage consuming module, and then to regulate a current conducted by the leakage current path.

So when the current in the switch is decreasing, the first control means switch off the switch at first, before the second control means activate the leakage current path. Therefore, no useful output current is derived through the leakage current path out of the load resistor.

Because such a module provided by an embodiment of the invention is intended to be added to an LDO regulator, it does not require that this latter be modified or re-designed. Therefore, existing LDO regulators can be used without their topology being changed.

The module provided by an embodiment of the invention provides an additional current path in parallel to the pull-down path of the output stage of the LDO regulator. This additional current path may be active only when the sum of the current output by the LDO regulator and the pull-down path current is lower than a leakage current of the switch. Therefore, it is denoted "leakage current path".

The first control means of the active leakage consuming module may comprise a first current source with a first terminal of this first current source to be connected to the control terminal of the switch, and a second terminal of the first current source to be connected to the second terminal of the power supply unit. Such an embodiment of the first control means is relatively simple and easy to implement.

The LDO regulator may comprise:

- a differential amplifier, which has a reference input terminal, a feedback input terminal and a own output terminal;
- a gain stage, which comprises a bias resistor and a MOS transistor, with this MOS transistor having a first main terminal connected to the first terminal of the power supply unit of the LDO regulator, a second main terminal connected to the second terminal of the power supply unit through the bias resistor, and a gate terminal connected to the output terminal of the differential amplifier.

The control terminal of the switch of the output stage may be connected to a node of the gain stage between the bias resistor and the MOS transistor. In addition, the pull-down path may comprise a feedback output terminal designed for supplying a feedback voltage which is representative for an LDO output voltage existing at the output terminal of the LDO regulator, with this feedback output terminal being connected to the feedback input terminal of the differential amplifier.

For such an LDO regulator, the second control means of the active leakage consuming module may comprise:

- a first additional transistor of the same transistor type as the MOS transistor of the gain stage, with this first additional transistor having a first main terminal to be connected to the first terminal of the power supply unit, a second main terminal and a gate terminal, this gate terminal of the first additional transistor to be connected to the output terminal of the differential amplifier;
- a second current source with a first terminal of this second current source connected to the second terminal of the first additional transistor, and a second main terminal of the second current source connected to the second terminal of the power supply unit; and
- a first current mirror unit, which has a first input terminal connected to a node between the first additional transistor and the second current source, a second input terminal to be connected to the output terminal of the LDO regulator, and an output terminal of this first current mirror unit to be connected to the first terminal of the power supply unit, this first current mirror unit being adapted so that a current flowing in its second input terminal is controlled by a current flowing in its first input terminal, and the first current mirror unit forming the leakage current path of the active leakage consuming module between its second input terminal and its output terminal.

Such an embodiment of the second control means is also relatively simple and easy to implement.

A current of the second current source may be less than a current of the first current source.

The active leakage consuming module may further comprise a load current optimization circuit with:

- a control terminal of this load current optimization circuit, which is connected to an output of the second control means of the active leakage consuming module; and
- an output terminal of the load current optimization circuit, which is connected to the second terminal of the leakage current path.

The load current optimization circuit may be adapted to produce a current in the output terminal of this load current optimization circuit with an absolute current value which decreases as the second control means go on further activating the leakage current path. The current produced by such load current optimization circuit may act as a partial substitution for the current consumed by the LDO regulator, thereby further reducing the latter.

Thanks to the leakage current path being inactive when the output current of the LDO regulator is high enough for the switch to be on, the dynamic performances and the stability of the LDO regulator are not altered by the implementation of the load current optimization circuit, for high current output by the LDO regulator.

The control terminal of the load current optimization circuit may be connected to the node between the first additional transistor and the second current source. Then, the load current optimization circuit may be adapted so that the absolute value of the current produced in the output terminal of this load current optimization circuit decreases as an absolute value of a voltage existing at the control terminal of the load current optimization circuit increases.

The load current optimization circuit may comprise:

a resistor;

a bias MOS transistor with a first main terminal of this bias MOS transistor connected to the first terminal of the power supply unit through the resistor, a gate terminal forming bias control terminal, and a second main terminal of this bias MOS transistor;

a second current mirror unit with an input terminal of this second current mirror unit which is connected to the second terminal of the power supply unit, a first output terminal of the second current mirror unit which is connected to the second main terminal of the bias MOS transistor, and a second output terminal of the second current mirror unit which forms the output terminal of the load current optimization circuit, the second current mirror unit being adapted so that a current flowing in its second output terminal is controlled by a current flowing in its first output terminal; and a second additional transistor of the same transistor type as the first additional transistor, the second additional transistor having a first main terminal which is connected to a node between the resistor and the bias MOS transistor, a second main terminal which connected to the second terminal of the power supply unit, and a gate terminal which forms the control terminal of the load current optimization circuit.

The second current mirror unit may be adapted so that the current flowing in its second output terminal is equal to the current flowing in its first output terminal, multiplied by a factor greater than five.

According to a second aspect, there is provided an LDO circuitry which comprises an LDO regulator and an active leakage consuming module.

The LDO regulator of the LDO circuitry may comprise an output stage, which comprises itself a switch and a pull-down path. The switch has a first main terminal which is connected to a first terminal of a power supply unit through the pull-down path, a second main terminal which is connected to a second terminal of the power supply unit, and a control terminal. In addition, a node between the switch and the pull-down path forms an output terminal of the LDO regulator.

The active leakage consuming module of the LDO circuitry comprises:

a leakage current path with a first terminal of this leakage current path which is connected to the first terminal of the power supply unit, and a second terminal of the leakage current path which is connected to the output terminal of the LDO regulator;

first control means, which are connected to the control terminal of the switch, and adapted to switch off the switch before the leakage current path is activated, when the current in the first main terminal of the switch is decreasing; and second control means, which are adapted to activate the leakage current path only after the switch has been switched off.

In an LDO circuitry according to an embodiment of the invention, the LDO regulator may further comprise a differential amplifier and a gain stage as recited above. The active leakage consuming module may also comprise any of the features already mentioned above in connection with the first aspect. In addition, in embodiments where both the first control means and the second control means comprise respectively first and second current sources, with the current of the second current source being less than that of the first current source, then the first additional transistor of the active leakage consuming module may be identical to the MOS transistor of the gain stage.

DETAILED DESCRIPTION OF THE INVENTION

Figure 1:
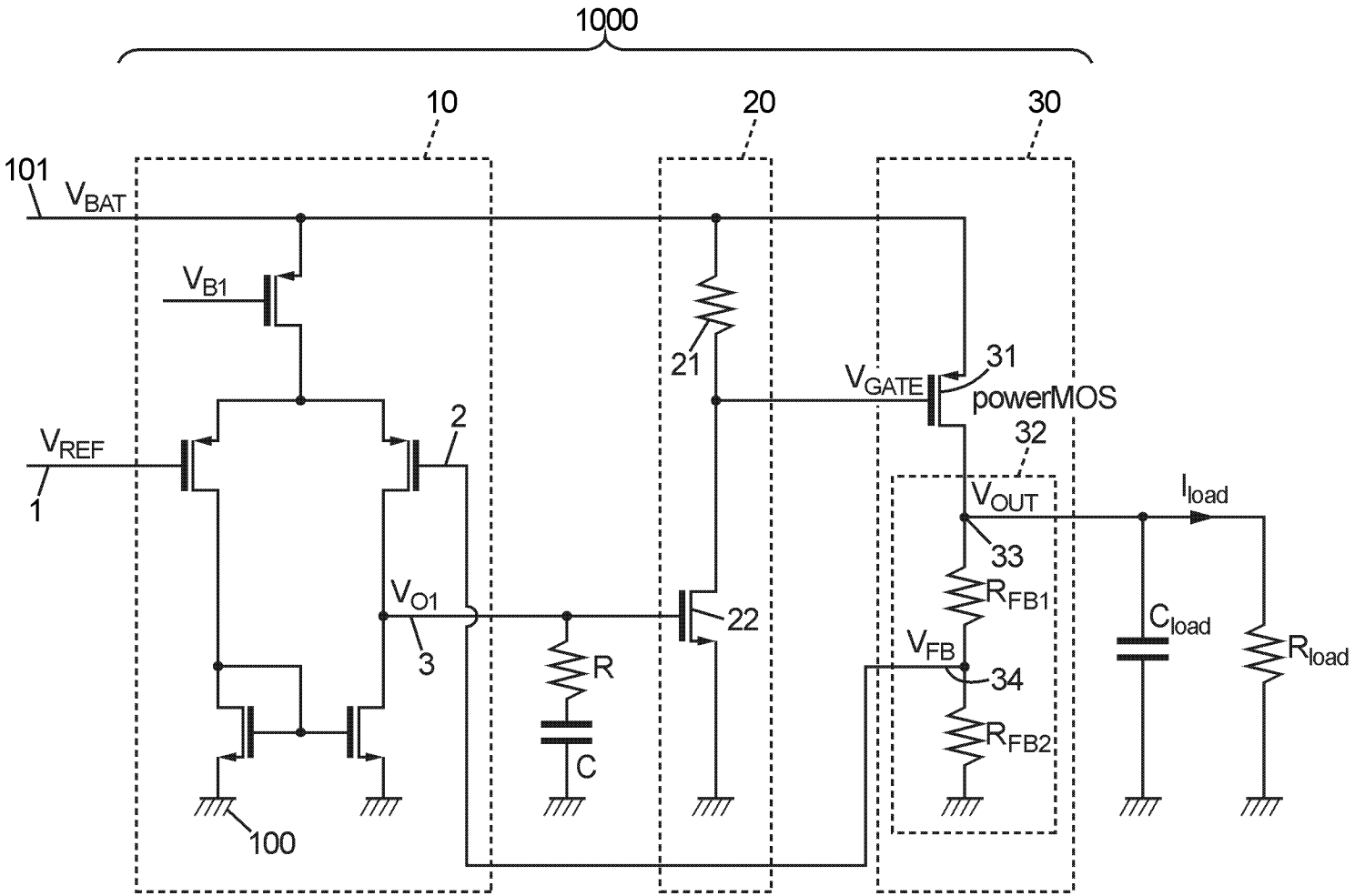
FIG. 1 (PRIOR ART)
FIG. 1 is a circuit diagram of an LDO regulator.
Figure 2:
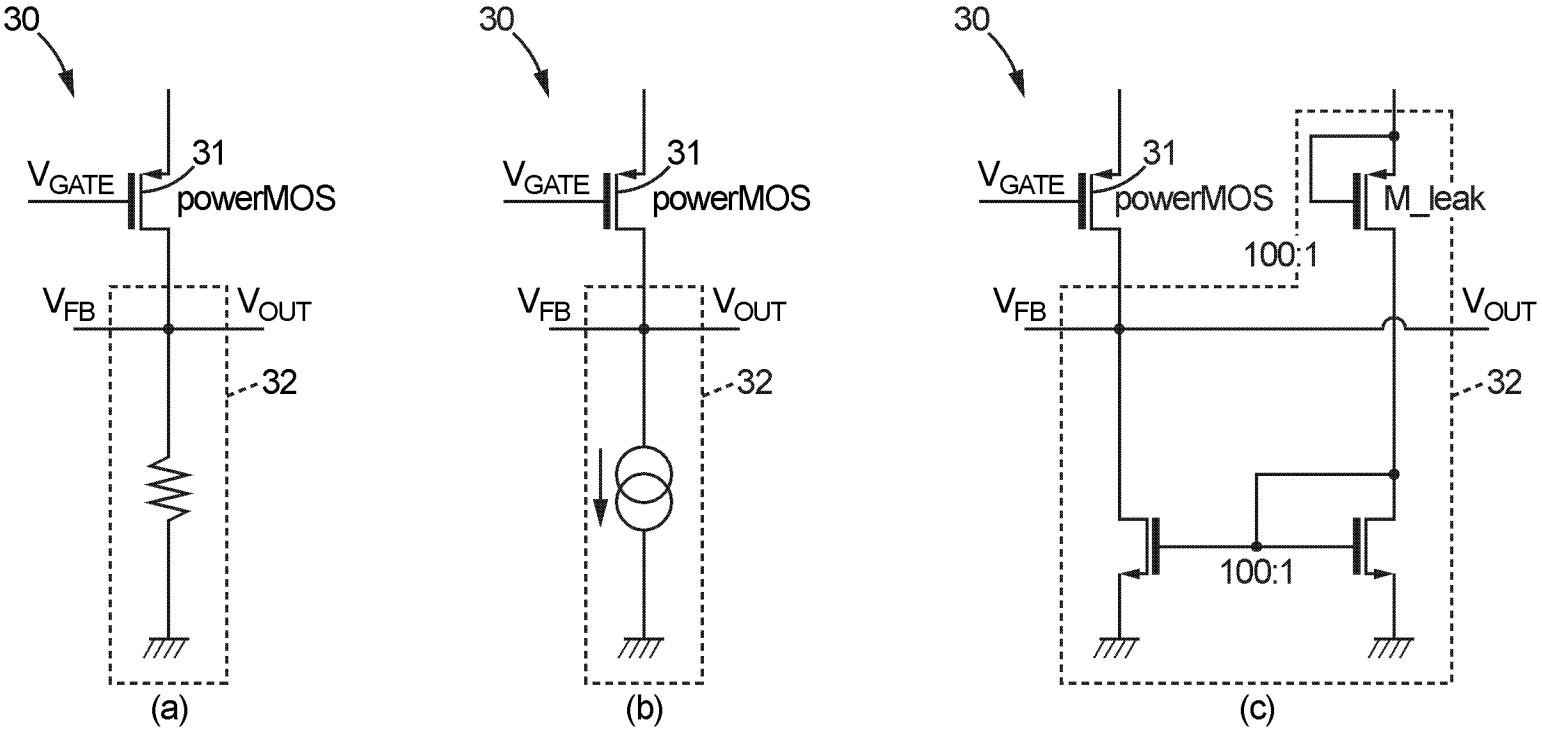
FIG. 2 (PRIOR ART)
FIGS. 2*a* to 2*c* represent alternative embodiments of part of the LDO regulator of FIG. 1.
Figure 3:
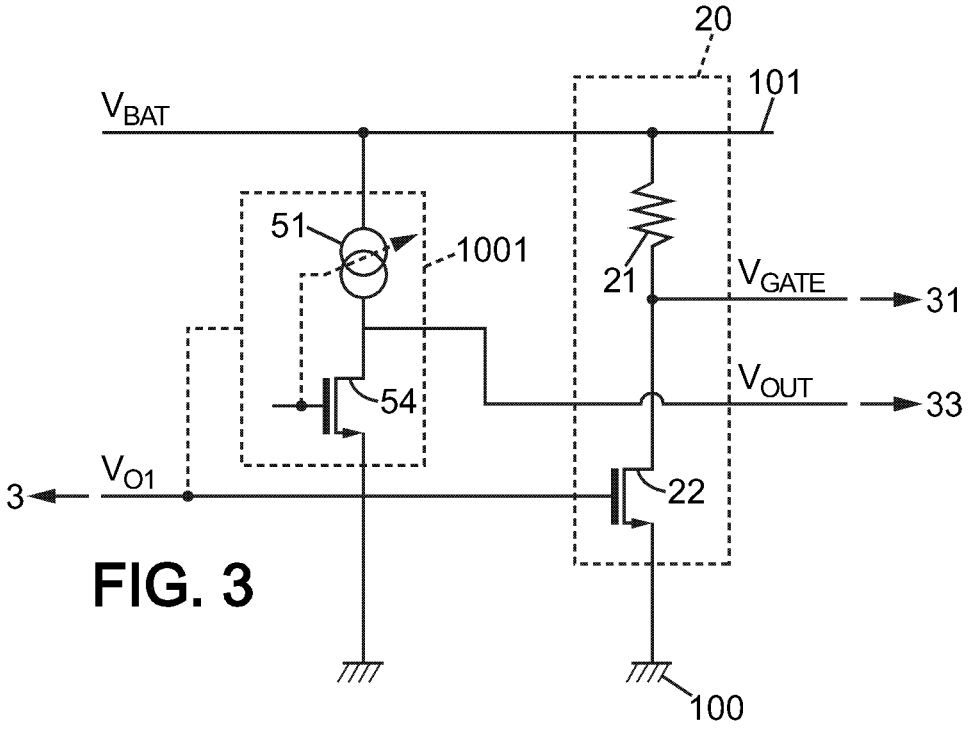
FIG. 3 is a circuit diagram which illustrates the principle of an active leakage consuming module in accordance with embodiments of the present invention.
Figure 4:
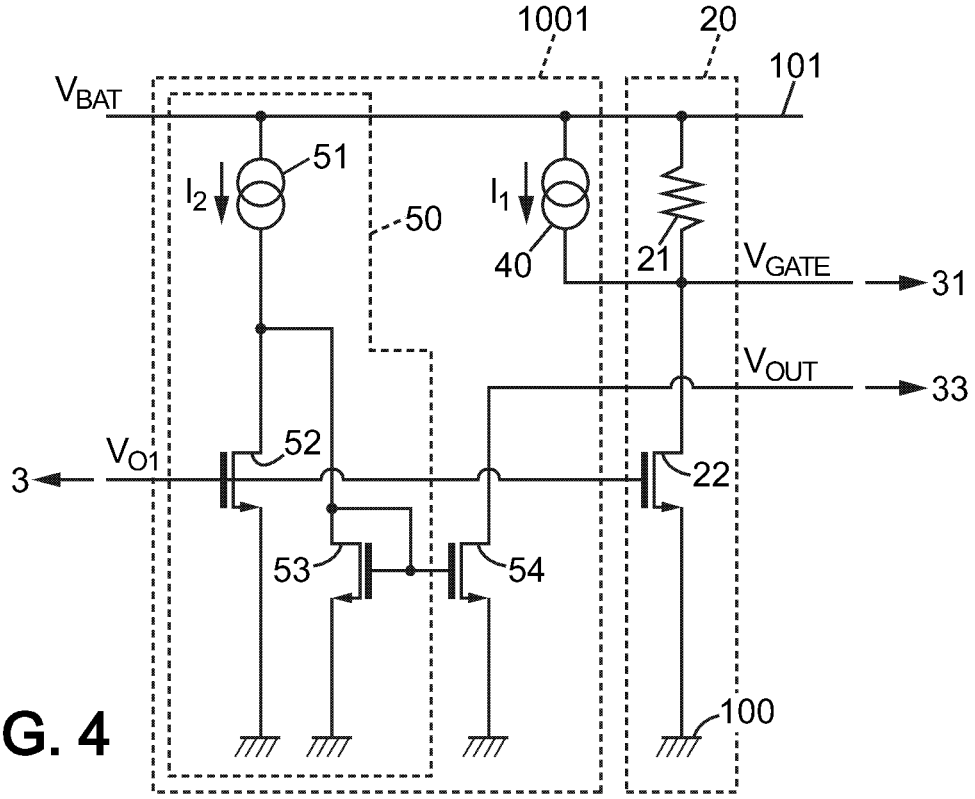
FIGS. 4 and 5 are circuit diagrams of active leakage consuming modules in accordance with embodiments of the present invention.
Figure 5:
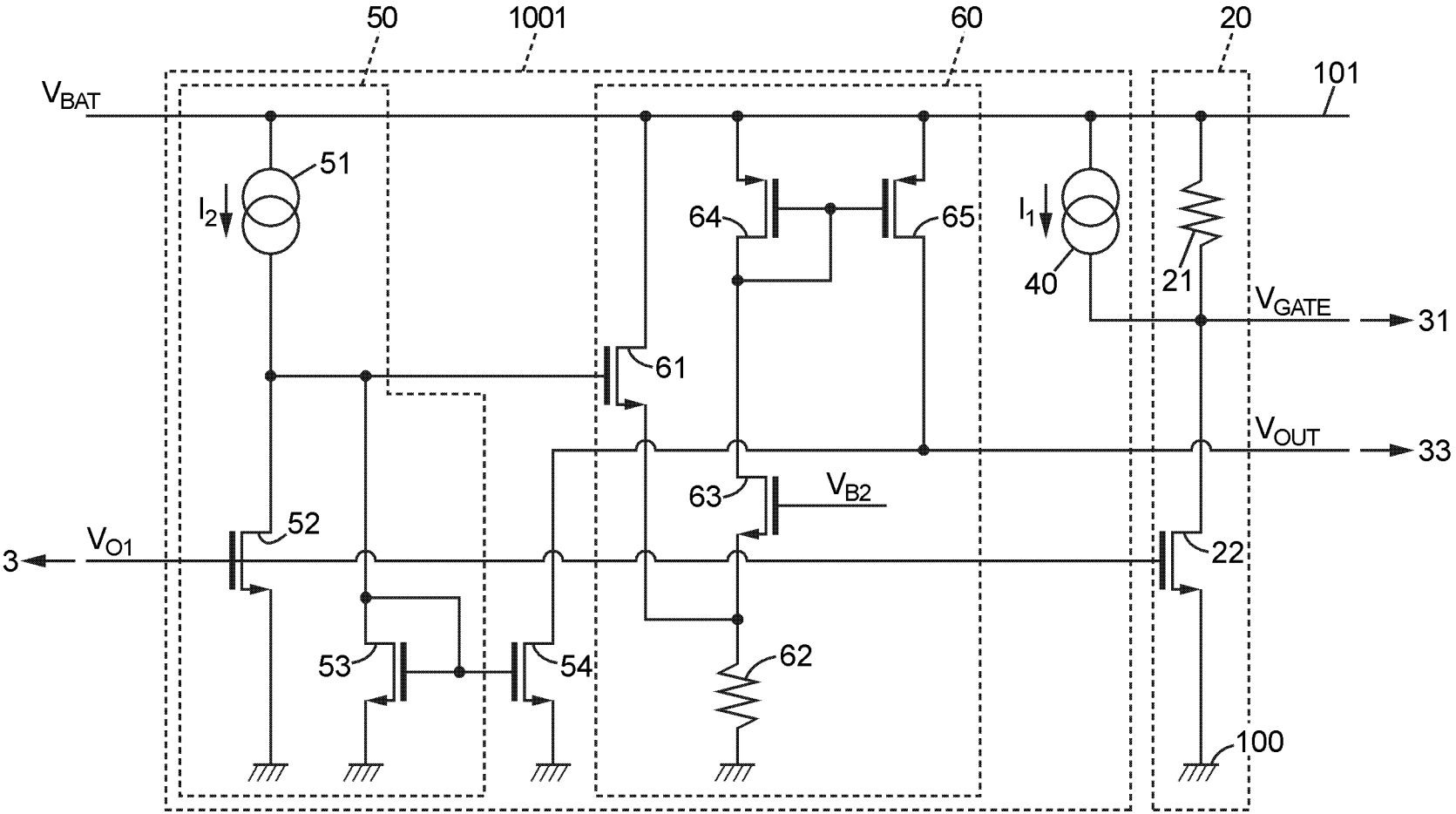

In FIGS. 1 to 5, elements and voltages which are the same are referred to with the same reference numbers and same voltage indications, respectively in the different figures. FIGS. 3 to 5 are focused on the active leakage consuming module provided by embodiments of the invention, and show its connections to the LDO regulator 1000 of FIG. 1. Reference number 1001 generally denotes the module as a whole.

According to an embodiment illustrated in FIG. 3, the active leakage consuming module 1001 comprises control means in the form of at least one current source 51, and a current path 54. The current source 51 and the current path 54 may virtually appear as being connected in series between the terminals 100 and 101 of the power supply unit of the LDO regulator 1000. The positive terminal of current source 51 is connected to the terminal 101, and its negative terminal is virtually connected to an entrance node of the current path 54. In a simple manner, the current path 54 may be comprised of a MOS transistor, as illustrated in FIG. 3. The output terminal 33 of the LDO regulator 1000 is also connected to the entrance node of the current path 54. Then, if the total current output by the powerMOS transistor 31 becomes low enough, the MOS transistor 22 turns off and the transistor of the current path 54 is controlled so as to open. Then, the leakage current of the powerMOS transistor 31 can flow through both the current path 54 and the pull-down path 32, which appear then to be in parallel with each other. For such operation, the value of the current source 51 is tuned so that the transistor of the current path 54 turns on when the current in the bias resistor 21 corresponds to all the internal loads of the LDO regulator 1000, plus some margin. In particular, the quiescent current of the LDO regulator 1000 is reduced, because the MOS transistor 22 is then off. Furthermore, if the leakage current of the powerMOS transistor 31 has become significant compared to the output current $I_{load}$, then the leakage current flows in the transistor of the current path 54 instead of the current from the current source 51. This latter can then be turned off. In addition, for higher value of the output current $I_{load}$, the control of the module 1001 using the voltage $V_{O1}$ output by the differential amplifier 10, in parallel with the control of the MOS transistor 22, ensures that the current path 54 is closed when the MOS transistor 22 is open.

As indicated in FIG. 3, the module 1001 may be connected to the LDO regulator 1000 without this latter being modified in its principle and its topology. The LDO regulator 1000 provided with the module 1001 forms a resulting LDO circuitry according to an embodiment of the invention.

FIG. 4 shows a possible practical embodiment of the module 1001. The control means of the module 1001 comprise first and second control means. The first control means may comprise a first current source 40 which is connected in parallel to the bias resistor 21 of the gain stage 20. Thus, the current source 40 has a first terminal connected the gate terminal of the powerMOS transistor 31, and a second terminal connected to the terminal 101 of the power supply unit. When the load current $I_{load}$ decreases to low values and even to zero, then the drain current of the MOS transistor 22 also decreases. As this latter current becomes almost equal to the current value $I_1$ of the current source 40, then the gate voltage $V_{GATE}$ of the powerMOS transistor 31 rises to the voltage $V_{BAT}$ of the power supply unit, so that the powerMOS transistor 31 turns off. Once the powerMOS transistor 31 is thus switched-off, then the current output by the powerMOS transistor 31 is its leakage current.

The second control means of the regulator 1001 are denoted 50 and may comprise:

- a first additional transistor 52 of the same transistor type as the MOS transistor 22 of the gain stage 20, and having a first main terminal connected to the terminal 100 of the power supply unit, a second main terminal and a gate terminal, the gate terminal of the additional transistor 52 being connected to the output terminal 3 of the differential amplifier 10;
- a second current source 51 having a first terminal connected to the second main terminal of the additional transistor 52, and a second terminal connected to the terminal 101 of the power supply unit; and
- a first current mirror unit having a first input terminal connected to a node between the additional transistor 52 and the second current source 51, a second input terminal connected to the output terminal 33 of the LDO regulator 1000, and an output terminal of this first current mirror unit connected to the terminal 100 of the power supply unit.

The first current mirror unit is adapted so that a current flowing in its second input terminal is controlled by a current flowing in its first input terminal. In this way, the first current mirror unit forms the leakage current path of the active leakage consuming module 1001, between the second input terminal and the output terminal of this current mirror unit. According to a simple module embodiment, such first current mirror unit may be produced with two paired n-MOS transistors 53 and 54 connected in parallel in the following manner:

- their respective source electrodes are both connected to the terminal 100 of the power supply unit to form together the output terminal of the first current mirror unit;
- the drain electrodes of the MOS transistors 53 and 54 form respectively the first and second input terminals of the first current mirror unit; and
- the respective gate electrodes of the MOS transistors 53 and 54 are connected to one another and further connected to the drain electrode of the MOS transistor 53.

The MOS transistor 54 thus forms the leakage current path of the module 1001 discussed in connection with FIG. 3.

The value of the current $I_2$ of the current source 51 is selected so that the transistor 52 turns off for values of the output current $I_{load}$ which are lower than those producing the switch-off of the powerMOS transistor 31. According to a possible implementation for such selection of the current $I_2$, this latter may be less than the current $I_1$ of the current unit 40 when the additional transistor 52 of the module 1001 is identical to the MOS transistor 22 of the gain stage 20. The inequality between the $I_1$ and $I_2$ currents ensures that the powerMOS transistor 31 and the MOS transistor 54 are never open at the same time. Indeed, if they were both open simultaneously, then the quiescent current of LDO regulator 1000 would be higher and stability issues would appear.

When the load current $I_{load}$ of the LDO regulator 1000 decreases down to zero, and after the current source 40 has made the powerMOS transistor 31 to switch-off, if the leakage current pulls up the output voltage $V_{OUT}$ of the LDO regulator 1000, then the voltage $V_{O1}$ output by the differential amplifier 10 goes down, which causes the additional transistor 52 to close. Then the current $I_2$ from the current source 51 starts flowing into the MOS transistor 53, which in turn makes the MOS transistor 54 consuming the leakage current of the powerMOS transistor 31. In the jargon of the Man skilled in electronics, the output of LDO circuitry created by the powerMOS transistor 31 together with the MOS transistor 54 is working as a class B push-pull stage.

For example, for $I_1$ set to 2 μA (microampere), $I_2$ set to 1 μA, and the MOS transistors 52 and 22 being identical, then the output voltage $V_{O1}$ of the differential amplifier 10 with value from 0 to ~0.6 V (volt) controls the MOS transistor 52. When voltage $V_{O1}$ reaches 0.6 V, then the MOS transistor 52 drives current $I_2$ and the leakage current path through the MOS transistor 54 is switched off. For voltage $V_{O1}$ from ~0.6 V to ~0.7 V, the MOS transistor 52 is fully open but the current through the MOS transistor 22 is still less than $I_1$, and the powerMOS transistor 31 is still switched off. When voltage $V_{O1}$ steps over ~0.7 V, then the current in the MOS transistor 22 becomes higher than $I_1$, and the powerMOS transistor 31 starts to operate. Thus, a first operation threshold appears when $V_{O1}$=0.7 V and the current in the MOS transistor 22 is 2 μA. A second operation threshold additionally appears for $V_{O1}$=0.6 V and the current in the MOS transistor 52 is 1 μA. The difference between 2 μA and 1 μA, or between 0.7 V and 0.6 V on $V_{O1}$, creates the safety gap in order to avoid activation of both the powerMOS transistor 31 and the leakage current path of the MOS transistor 54 at the same time.

FIG. 5 shows an active leakage consuming module 1001 which is completed with a load current optimization circuit 60. In a practical embodiment when the second control means 50 of the module 1001 are in accordance with FIG. 4, such load current optimization circuit 60 may comprise:

- a resistor 62;
- a bias MOS transistor 63 with a first main terminal of this bias MOS transistor connected to the terminal 100 of the power supply unit through the resistor 62, a gate terminal, and a second main terminal of the same bias MOS transistor 63;
- a second current mirror unit with an input terminal of this second current unit which is connected to the terminal 101 of the power supply unit, a first output terminal of the same second current mirror unit which is connected to the second main terminal of the bias MOS transistor 63, the second current mirror unit 60 being adapted so that a current flowing in a second output terminal of this second current mirror unit is controlled by a current flowing in a first output terminal of the same second current mirror unit; and a second additional transistor 61 of the same transistor type as the first additional transistor 52, with a first main terminal of the additional transistor 61 which is connected to a node between the resistor 62 and the bias MOS transistor 63, and a second main terminal of the additional transistor 61 which is connected to the terminal 101 of the power supply unit.

The gate electrode of the bias MOS transistor 63 forms a bias control terminal with applied bias voltage denoted $V_{B2}$. The bias transistor 63 may be of n-MOS type.

A gate terminal of the additional transistor 61 forms the control terminal of the load current optimization circuit 60. It is connected to the node between the additional transistor 52 and the current source 51.

The second output terminal of the second current mirror unit forms the output terminal of the load current optimization circuit 60, which is connected to the drain electrode of the MOS transistor 54.

The second current mirror unit may be produced with two p-MOS transistors 64 and 65 connected in parallel in the following manner:

their respective drain electrodes are both connected to the terminal 101 of the power supply unit to form together the input terminal of this second current mirror unit;

the source electrodes of the MOS transistors 64 and 65 form respectively the first and second output terminals of the second current mirror unit; and the respective gate electrodes of the MOS transistors 64 and 65 are connected to one another and further connected to the source electrode of the MOS transistor 64.

An appropriate selection of the respective features of the MOS transistors 64 and 65 produces a desired ratio between the values of the currents flowing in the first and second output terminals of the second current mirror unit. Preferably, the current in the second output is at least five or better ten times greater than the current in the first output. Then, the current produced in use by the bias MOS transistor 63 in the resistor 62 is much lower than the current value $I_2$ of the current source 51. Further reduction in the total current consumed is thus obtained.

The current from the MOS transistor 65 acts as an artificial leakage current. The accuracy of this current from the MOS transistor 65 is not critical. It only has to be set higher than the internal loads of the LDO regulator 1000, namely the total resistance of the pull-down path 32. If the current $I_{load}$ which is fed by the LDO regulator 1000 into the load resistor $R_{load}$ goes below a threshold defined by the current from the MOS transistor 65, then the powerMOS transistor 31 turns off. The current consumption is thus reduced and the current from the MOS transistor 65 starts decreasing because the second additional transistor 61 is opening. If the load current $I_{load}$ is zero, then the MOS transistor 65 is closed, and if there is a leakage current through the powerMOS transistor 31, then the MOS transistor 54 is activated.

Figure 6:
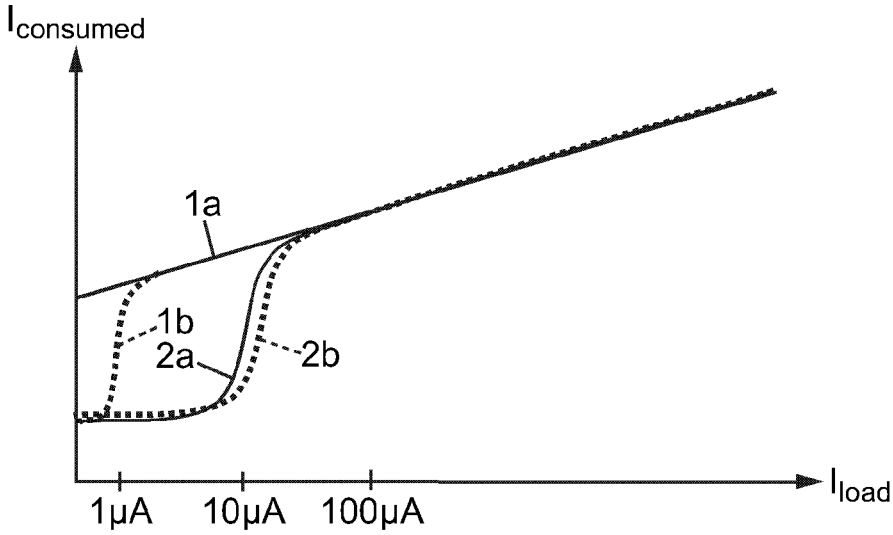
FIG. 6 is a diagram according to an elucidating example.

FIG. 6 represents the variations of the current consumed internally in the LDO regulator 1000 when using the invention. X-axis indicates the load current $I_{load}$ fed into the load resistor $R_{load}$. The various curves reported are the following ones:

curves 1*a* and 1*b* are those of the current consumption when the active leakage consuming circuit 1001 is used without the load current optimization circuit 60. Curve 1*a* refers to the situation of no leakage current within the powerMOS transistor 31, and curve 1*b* refers to the situation of non-zero leakage current. More precisely, and because leakage current actually always exists for the powerMOS transistor 31, curve 1*a* refers to the situation of this leakage current being smaller than the current in the pull-down path 32, and the curve 1*b* refers to the leakage current being higher than the pull-down path current. The threshold which is visible on curve 1*b* at about 1 μA (microampere) for the load current $I_{load}$, results from the consumption of the powerMOS transistor leakage current. For example, if this leakage current is 2 μA and the pull-down path 32 consumes 1 μA, then the external loads, namely the load resistor $R_{load}$ and the leakage current path 32, can be covered by current up to 1 μA.

curves 2*a* and 2*b* are those of the current consumption when the active leakage consuming circuit 1001 is completed with the load current optimization circuit 60. Curve 2*a* refers to the situation of no leakage current within the powerMOS transistor 31, and curve 2*b* refers to the actual situation of non-zero leakage current. By selecting the bias voltage $V_{B2}$ applied on the gate electrode of the bias MOS transistor 63, the current output by the MOS transistor 65 in its source electrode has been set to about 10 to 20 μA. These curves 2*a* and 2*b* actually show the shift which is thus obtained for the threshold of curve 1*b* to higher currents. Thus, the current consumption is reduced regardless of the value of the leakage current.

The present invention has been described above with reference to specific embodiments. However, other embodiments than the above described are possible. The different features of the embodiments may be combined in other combinations than those described. In addition, the Man skilled in the art will be able to select appropriately the numeral values for all components, depending on the application intended for each LDO regulator. Also, the transistor types are to be inverted if the voltage $V_{BAT}$ of the power supply unit is negative. But some of the main advantages of invention embodiments will remain, in particular:

implementing a low-power operating mode without necessarily having to modify the operation of the LDO regulator for higher output current values, including without impairing stability for these higher values so that no further frequency compensation is required. This low-power operating mode leads to reduction in the consumed current in both cases of zero and non-zero leakage current of the powerMOS transistor of the LDO regulator; and the proposed module can be added to an LDO regulator without modification of existing LDO structures.

The invention claimed is:

1. An active leakage consuming module configured for being connected to a Low Drop-Out (LDO) regulator that is external to said active leakage consuming module and comprises an output stage comprising a switch and a pull-down path, said switch having a first main terminal connected to a first terminal of a power supply unit through the pull-down path, a second main terminal connected to a second terminal of the power supply unit, and a control terminal, wherein a node between the switch and the pull-down path forms an output terminal of the LDO regulator, the active leakage consuming module comprising:

a leakage current path having a first terminal configured to be connected to the first terminal of the power supply unit, and a second terminal configured to be connected to the output terminal of the LDO regulator;

a first controller configured to be connected to the control terminal of the switch, and configured to turn off the switch before the leakage current path is activated, when the current in the first main terminal of the switch is decreasing during an operation of the LDO regulator provided with the active leakage consuming module; and a second controller configured to activate the leakage current path only after the switch has been turned off during said operation of the LDO regulator provided with the active leakage consuming module, and then to regulate a current conducted by the leakage current path.

2. The active leakage consuming module of claim 1, wherein the first controller comprises a first current source having a first terminal configured to be connected to the control terminal of the switch, and a second terminal configured to be connected to the second terminal of the power supply unit.

3. The active leakage consuming module of claim 1, wherein the LDO regulator further comprises:

a differential amplifier including a reference input terminal, a feedback input terminal, and an output terminal; and a gain stage comprising a bias resistor and a MOS transistor, the MOS transistor comprising a first main terminal connected to the first terminal of the power supply unit of the LDO regulator, a second main terminal connected to the second terminal of the power supply unit through the bias resistor, and a gate terminal connected to the output terminal of the differential amplifier;

wherein the control terminal of the switch of the output stage is connected to a node of the gain stage between the bias resistor and the MOS transistor;

wherein the pull-down path comprises a feedback output terminal configured to supply a feedback voltage representative of an LDO output voltage existing at the output terminal of the LDO regulator, said feedback output terminal being connected to the feedback input terminal of the differential amplifier;

wherein the second controller comprises:

a first additional transistor of the same transistor type as the MOS transistor of the gain stage, said first additional transistor having a first main terminal configured to be connected to the first terminal of the power supply unit, a second main terminal, and a gate terminal configured to be connected to the output terminal of the differential amplifier;

a second current source including a first terminal connected to the second terminal of the first additional transistor, and a second main terminal connected to the second terminal of the power supply unit; and a first current mirror unit including a first input terminal connected to a node between the first additional transistor and the second current source, a second input terminal configured to be connected to the output terminal of the LDO regulator, and an output terminal configured to be connected to the first terminal of the power supply unit, said first current mirror unit being configured so that a current flowing in the second input terminal of the first current mirror unit is controlled by a current flowing in the first input terminal of the first current mirror unit;

wherein the first current mirror unit forms the leakage current path of the active leakage consuming module between the second input terminal and the output terminal of the first current mirror unit.

4. The active leakage consuming module of claim 3, wherein a current of the second current source is less than a current of the first current source.

5. The active leakage consuming module of claim 1, further comprising a load current optimization circuit that includes:

a control terminal connected to an output of the second controller of the active leakage consuming module; and an output terminal connected to the second terminal of the leakage current path;

wherein the load current optimization circuit is configured to produce a current in the output terminal of said load current optimization circuit with an absolute current value which decreases as the second controller activates the leakage current path.

6. The active leakage consuming module of claim 5:

wherein the control terminal of the load current optimization circuit is connected to the node between the first additional transistor and the second current source; and wherein the load current optimization circuit is configured so that the absolute value of the current produced in the output terminal of the load current optimization circuit decreases as an absolute value of a voltage existing at the control terminal of said load current optimization circuit increases.

7. The active leakage consuming module of claim 6, wherein the load current optimization circuit also includes:

a resistor;

a bias MOS transistor having a first main terminal connected to the first terminal of the power supply unit through the resistor, a gate terminal forming bias control terminal, and a second main terminal;

a second current mirror unit having an input terminal connected to the second terminal of the power supply unit, a first output terminal connected to the second main terminal of the bias MOS transistor, and a second output terminal forming the output terminal of the load current optimization circuit, said second current mirror unit being configured so that a current flowing in the second output terminal of the second current mirror unit is controlled by a current flowing in the first output terminal of the second current mirror unit; and a second additional transistor of the same transistor type as said first additional transistor, said second additional transistor having a first main terminal connected to a node between the resistor and the bias MOS transistor, a second main terminal connected to the second terminal of the power supply unit, and a gate terminal forming the control terminal of the load current optimization circuit.

8. The active leakage consuming module of claim 7, wherein the second current mirror unit is configured so that the current flowing in the second output terminal of the second current mirror unit is equal to the current flowing in the first output terminal of the second current mirror unit, multiplied by a factor greater than five.

9. Low Drop-Out (LDO) circuitry comprising an LDO regulator and an active leakage consuming module, wherein the LDO regulator comprises:

an output stage comprising a switch and a pull-down path, said switch having a first main terminal connected to a first terminal of a power supply unit through the pull-down path, a second main terminal connected to a second terminal of the power supply unit, and a control terminal, wherein a node between the switch and the pull-down path forms an output terminal of the LDO regulator;

wherein the active leakage consuming module comprises:

a leakage current path having a first terminal configured to be connected to the first terminal of the power supply unit, and a second terminal configured to be connected to the output terminal of the LDO regulator;

a first controller configured to be connected to the control terminal of the switch, and configured to turn off the switch before the leakage current path is activated, when a current in the first main terminal of the switch decreases during operation of the LDO regulator; and a second controller configured to activate the leakage current path only after the switch has been turned off during said operation of the LDO regulator provided with the active leakage consuming module, and then to regulate a current conducted by the leakage current path;

wherein the first terminal of the leakage current path is connected to the first terminal of the power supply unit, and the second terminal of said leakage current path is connected to the output terminal of the LDO regulator; and wherein the first controller is connected to the control terminal of the switch.

10. The LDO circuitry of claim 9, wherein the LDO regulator further comprises:

a differential amplifier having a reference input terminal, a feedback input terminal and an output terminal; and a gain stage comprising a bias resistor and a MOS transistor, said MOS transistor having a first main terminal connected to the first terminal of the power supply unit of the LDO regulator, a second main terminal connected to the second terminal of the power supply unit through the bias resistor, and a gate terminal connected to the output terminal of the differential amplifier;

wherein the control terminal of the switch of the output stage is connected to a node of the gain stage between the bias resistor and the MOS transistor; and wherein the pull-down path comprises a feedback output terminal configured to supply a feedback voltage representative of an LDO output voltage existing at the output terminal of the LDO regulator, said feedback output terminal being connected to the feedback input terminal of the differential amplifier.

11. The LDO circuitry of claim 9, wherein the first controller comprises a first current source having a first terminal configured to be connected to the control terminal of the switch, and a second terminal configured to be connected to the second terminal of the power supply unit.

12. The LDO circuitry of claim 11, wherein the second controller comprises:

a first additional transistor of the same transistor type as the MOS transistor of the gain stage, said first additional transistor having a first main terminal configured to be connected to the first terminal of the power supply unit, a second main terminal, and a gate terminal configured to be connected to the output terminal of the differential amplifier;

a second current source having a first terminal connected to the second terminal of the first additional transistor, and a second main terminal connected to the second terminal of the power supply unit; and a first current mirror unit having a first input terminal connected to a node between the first additional transistor and the second current source, a second input terminal configured to be connected to the output terminal of the LDO regulator, and an output terminal configured to be connected to the first terminal of the power supply unit, said first current mirror unit being configured so that a current flowing in the second input terminal of the first current mirror unit is controlled by a current flowing in the first input terminal of the first current mirror unit;

wherein the first current mirror unit forms the leakage current path of the active leakage consuming module between the second input terminal and the output terminal of said first current mirror unit;

wherein a current of the second current source is less than a current of the first current source; and wherein the first additional transistor is identical to the MOS transistor of the gain stage.

* * * * *